United States Patent [19]

Nakai et al.

[11] Patent Number: 4,693,746

[45] Date of Patent: Sep. 15, 1987

[54] CUBIC BORON NITRIDE SINTERED COMPACT FOR END MILL

[75] Inventors: Tetsuo Nakai; Mitsuhiro Goto, both of Itami, Japan

[73] Assignee: Sumitomo Electric Industries, Ltd., Osaka, Japan

[21] Appl. No.: 567

[22] Filed: Jan. 5, 1987

[30] Foreign Application Priority Data

Jan. 6, 1986 [JP] Japan ..... 61-858

[51] Int. Cl.[4] ..... C22C 29/04

[52] U.S. Cl. ..... 75/238; 75/241; 75/244; 419/13; 419/16; 419/18; 419/23; 419/39; 419/48

[58] Field of Search ..... 75/238, 244, 241; 419/13, 16, 18, 23, 39, 48

[56] References Cited

U.S. PATENT DOCUMENTS

| | | | |
|---|---|---|---|
| 4,138,252 | 2/1979 | Vereschagin et al. | 75/244 |
| 4,236,926 | 12/1980 | Lindholm et al. | 75/238 |
| 4,342,595 | 8/1982 | Bourdeau | 75/244 |
| 4,566,905 | 1/1986 | Akashi et al. | 75/238 |
| 4,590,034 | 5/1986 | Hirano et al. | 75/244 |
| 4,596,693 | 6/1986 | Ishizuka et al. | 75/244 |
| 4,647,546 | 3/1987 | Hall et al. | 75/244 |
| 4,650,776 | 3/1987 | Cerceau | 75/238 |

FOREIGN PATENT DOCUMENTS 77811 7/1978 Japan .

*Primary Examiner*—Stephen J. Lechert, Jr.
*Attorney, Agent, or Firm*—W. G. Fasse; D. H. Kane, Jr.

[57] ABSTRACT

A cBN sintered compact for an end mill obtained by sintering mixed powder prepared by mixing about 35 to 50 percent by volume of cubic boron nitride powder smaller than about 2 μm in average particle size with about 50 to 65 percent by volume of a binder under cBN-stable superhigh pressure conditions. The binder contains about 20 to 30 percent by weight of Al and one or more Ti compounds selected from a group of $TiN_z$, $Ti(C,N)_z$, $TiC_z$, $(Ti,M)C_z$, $(Ti,M)(C,N)_z$ and $(Ti,M)N_z$ (where M indicates a transition metal element of the group IVa, Va or VIa of the periodic table excepting Ti and z is within a range of about $0.7 \leqq z \leqq$ about 0.85) and the atomic ratio of Ti contained in the binder to the transition metal element of the group IVa, Va or VIa of the periodic table excepting Ti is about $\frac{2}{3}$ to 97/100 while the total tungsten concentration of tungsten contained in the form of at least one of tungsten carbide or the Ti compound described above in the binder is about 5 to 20 percent by weight.

9 Claims, No Drawings

CUBIC BORON NITRIDE SINTERED COMPACT FOR END MILL

BACKGROUND OF THE INVENTION

1. Field of the Invention

The present invention relates to a sintered compact for a tool which is prepared by cubic boron nitride (hereinafter referred to as cBN), and particularly to an improvement in a cBN compact suitably used for an end mill.

2. Description of the Prior Art

Cubic boron nitride is the hardest substance next to diamond, and sintered compacts thereof are applied to various cutting tools. Japanese Patent Laying-Open Gazette No. 77811/1978 disclosed an example of such a cBN sintered compact applicable to a cutting tool.

The prior art discloses a hard sintered compact which mainly contains 80 to 40 percent by volume of cubic boron nitride and a residue of carbide, nitride, boride or silicide of a transition metal selected from groups IVa, Va and VIa of the periodic table, a mixture thereof or a mutual solid-solution compound thereof or those further comprising Si and/or Al. Such a compound is continuous in bonding phase in the structure of the sintered compact. This hard sintered compact for a tool employs carbide, nitride, boride or silicide of a transition metal selected from the groups IVa, Va and VIa of the periodic table, a mutual solid-solution compound thereof or the like. Such compounds are relatively hard and of high melting points. Therefore, sintered compacts prepared by these compounds generally present high performance in application to cutting tools.

A harder sintered compact is preferred in case of using the cBN sintered compact as a high hard sintered compact for cutting tools. Therefore, as described above, the compact containing high volume of cBN has been used. However, in case of the compact being applied to an end mill among cutting tools for cutting high hard materials, even the high hard sintered compact described above is frequently broken in an initial stage of cutting.

SUMMARY OF THE INVENTION

Accordingly, it is an object of the present invention to provide a cBN sintered compact which is difficult to be broken and is superior in abrasion resistance to the aforementioned conventional compact in case of using one for an end mill.

The inventors have made thorough study to obtain a cBN sintered compact which is not easily broken when the same is applied to an end mill, so that they have found that a cBN sintered compact suitable for an end mill can be obtained by mixing about 35 to 50 percent by volume of cBN particles smaller than about 2 $\mu$ m in average particle size, preferably smaller than 1 $\mu$ m, with about 50 to 65 percent by volume of the following binder and sintering the mixed powder under cBN-stable conditions.

The feature of the present invention resides in employment of cBN powder smaller than about 2 $\mu$ m in average particle size and a binder containing about 20 to 30 percent by weight of Al; and one or more Ti compounds selected from a group of $TiN_z$, $Ti(C,N)_z$, $TiC_z$, $(Ti,M)C_z$, $(Ti,M)(C,N)_z$ and $(Ti,M)N_z$ (where M indicates a transition metal element of the group IVa, Va or VIa of the periodic table excepting Ti and z is within a range of about $0.7 \leqq z \leqq$ about 0.85) in which the atomic ratio of Ti to the metal of the group IVa, Va or VIa of the periodic table excepting Ti is about $\frac{2}{3}$ to 97/100 and the total tungsten concentration of tungsten contained in the form of at least one of the Ti compound and tungsten carbide in the binder is about 5 to 20 percent by weight.

It is believed that the cBN sintered compact according to the present invention shows excellent performance in intermittent cutting through a tool such as an end mill for the following reason: It is believed that, when the cBN sintered compact is applied to an end mill, the cutting edge of the cBN sintered compact is abraded by slight chipping to increase cutting resistance, whereby the cutting edge is broken. Such slight chipping is caused by falling or breaking of the cBN particles. Therefore, it is believed that breaking and falling of the cBN particles can be prevented by decreasing the particle size of the cBN particles and reducing the content thereof.

According to the present invention, the binder used contains one or more Ti compounds selected from a group of $TiN_z$, $Ti(C,N)_z$, $TiC_z$, $(Ti,M)C_z$, $(Ti,M)(C,N)_z$ and $(Ti,M)N_z$ (where M indicates a transition metal element of the group IVa, Va or VIa of the periodic table excepting Ti). The binder further contains about 20 to 30 percent by weight of Al and about 5 to 20 percent by weight of tungsten. The binder itself is excellent in strength and superior in abrasion resistance. The binder is particularly improved in strength and abrasion resistance by containing tungsten.

Further, the binder contains Al, and it is believed that such Al improves bonding strength of cBN and the binder.

It is further believed that bonding strength of cBN and the binder is improved by introducing the Ti compound containing free Ti in the binder so that Ti reacts with cBN or part of the binder.

According to the present invention, the cBN powder must be smaller than about 2 $\mu$ m in particle size. If the cBN powder is larger than about 2 $\mu$ m in particle size, the cBN particles per se are easily broken.

The cBN content is preferably within a range of about 35 to 50 percent by volume. If the cBN content is less than about 35 percent by volume, hardness of the sintered compact is insufficient whereby the cutting edge is deformed in cutting. When the cBN content is in excess of about 50 percent by volume, on the other hand, chipping is easily caused by falling of the cBN particles.

The binder must contain about 20 to 30 percent by weight of Al. If the Al content in the binder is less than about 20 percent by weight, retaining force for cBN is reduced while hardness is reduced when the Al content exceeds about 30 percent by weight.

When the tungsten content in the binder is less than about 5 percent by weight, further, strength and abrasion resistance cannot be increased while bond strength within the binder is reduced when the tungsten content is in excess of about 20 percent by weight.

Excellent characteristics can be obtained when the atomic ratio of Ti to the transition metal element of the group IVa, Va or VIa of the periodic table excepting Ti is about $\frac{2}{3}$ to 97/100 in the binder. When the atomic ratio is less than about $\frac{2}{3}$, the Ti content is decreased to reduce bond strength of the binder itself and that of cBN and the binder, while bonding phases are reduced in abrasion resistance when the atomic ratio is in excess of about 97/100.

When tungsten is added in the form of tungsten carbide to the binder, strength and abrasion resistance of the binder can be further improved.

The binder preferably contains 20 to 30 percent by weight of Al as well as $TiN_z$, $(Ti,W)N_z$ and WC, to further improve the characteristics of the sintered compact.

As hereinabove described, various reactions take place in the sintering step for obtaining the sintered compact according to the present invention, while it has been found that the sintered compact is excellent in strength and abrasion resistance when titanium boride, aluminum boride, aluminum nitride, a tungsten compound and/or tungsten are produced as reaction products.

Description is now made on a method of manufacturing the cBN sintered compact for an end mill according to the present invention. First, cBN powder smaller than about 1 $\mu$ m in particle size is mixed with binder powder to obtain mixed powder. In order to uniformly disperse the binder in the final mixed powder in such mixing, a tungsten compound is preferably mixed with a Al or compound containing Al and a compound containing Ti, namely, $TiN_Z$, $Ti(C,N)_Z$, $TiC_Z$, $(Ti,M)N_Z$, $(Ti,M)(C,N)_Z$, $(Ti,M)C_Z$ [Z is about 0.7 to 0.85 and M indicates a transition metal element of the group IVa, Va or VIa of the periodic table excepting Ti] in advance, to thereafter mix the cBN powder. More preferably, WC powder, Ti compound powder and Al or an intermetallic compound of Ti and Al are made to react at a temperature of 1000° C. to 1500° C. and homogenized to be mixed with the cBN powder, thereby to further uniformly disperse the binder.

The value of z in the aforementioned chemical formulas of the Ti compounds is preferably within a range of about 0.7 to 0.85. Hardness of the sintered compact is exceedingly reduced when the value z is less than about 0.7, while, on the other hand, reaction between Ti and cBN or the binder is weakened by decrease of free Ti when the value z is in excess of about 0.85, whereby bond strength of cBN and the binder is reduced to cause falling of cBN particles.

The mixed powder thus obtained is generally degassed and crushed and preferably pressed and then it is sintered through a superhigh pressure apparatus. The sintering is performed under a pressure of about over 20 Kb and a temperature of 1000° C. to 1500° C. The range of pressure is decided by economical reasons, particularly durability of pressing units such as a chamber.

The cBN sintered compact for an end mill according to the present invention is obtained by mixing 35 to 50 percent by volume of cBN powder smaller than 2 $\mu$m in average particle size with about 50 to 65 percent by volume of the aforementioned binder and sintering the same under a superhigh pressure, whereby the sintered compact has a high hardness suitable for an end mill, to substantially prevent breaking of cBN particles in the initial stage of cutting.

DESCRIPTION OF THE PREFERRED EMBODIMENTS

Description is now made on Examples of the present invention.

EXAMPLE 1

$TiN_{0.75}$, WC and Al powder were mixed and homogenized at a temperature of 1200° C. and the binder thus obtained was pulverized through a ball mill to be smaller than about 1 $\mu$m in particle size. The binder powder thus obtained contained $TiN_{0.75}$, WC and Al in the weight ratio of 65:10:23. The atomic ratio of Ti to W was 95.5:43.

The binder powder was mixed in the volune ratio of 6:4 with cBN powder smaller than 1 $\mu$m in average particle size and degassed at a temperature of 1000° C., to obtain mixed powder. A disc of cemented carbide of WC-10 wt. %Co was placed in a Mo vessel and the aforementioned mixed powder was filled and then the vessel was sealed by a plug of Mo. Then, the vessel was retained under a pressure of 50 Kb and a temperature of 1300° C. for 15 minutes for sintering.

The sintered compact thus obtained was taken out from the Mo vessel for observation through a scanning type electron microscope, to recognize that the sintered compact, in which cBN particles smaller than 1 $\mu$m in average particle size were uniformly dispersed in the binder, was strongly bonded to cemented carbide. The sintered compact was further identified through X-ray diffraction, so that it was observed that the compact presented peaks considered as those of cBN, (Ti,W)(C,N), $TiB_2$, $AlB_2$, AlN and tungsten boride.

A straight end mill of 20 mm in diameter was manufactured through the aforementioned sintered compact. For the purpose of comparison, a straight end mill of 20 mm in diameter was manufactured by a sintered compact containing 60 percent by volume of cBN powder of 3 $\mu$m in average particle size and a residue of a binder similar to the above.

These end mills were adapted to cut SKT-4 materials ($H_{RC}$: 50) under the following conditions:

Speed of Rotation: 2000 r.p.m.
Axial Depth of Cut: 2 mm
Diametrical Depth of Cut: 20 mm
Rate of Feed: 3/100 mm/tooth As the result, the tip of the end mill of the sintered compact according to the present invention was abraded merely by 0.05 mm upon cutting of 5 m, while the end mill of the reference example was broken upon cutting

EXAMPLE 2

Finished powder materials as listed in Tables 1-1 and 1-2 were prepared to obtain sintered conpacts similarly to Example 1.

These sintered compacts were worked into end mills of 10 mm in diameter and 10 mm in effective cutting length and a cutting test was performed by cutting SKD-61 materials ($H_{RC}$: 52) by 10 m under the following conditions:

Speed of Rotation: 3200 r.p.m.
Axial Depth of Cut: 6 mm
Diametrical Depth of Cut: 2 mm
Rate of Feed: 0.01 mm/rev.

Table 2 shows the results.

TABLE 1-1

| Sample No. | cBN Particle Size * | cBN Content ** | Binder (wt. %) |
|---|---|---|---|
| A | 0.7 | 40 | $70(Ti_{0.9}W_{0.1})(C_{0.2}N_{0.8})_{0.75}$ 25AL.5WC |

TABLE 1-1-continued

| Sample No. | cBN Particle Size * | cBN Content ** | Binder (wt. %) |
|---|---|---|---|
| B | 0.5 | 35 | $62(Ti_{0.9},Ta_{0.05},Mo_{0.05})(C_{0.1},N_{0.9})_{0.7}$ 25Al,10wC |
| C | 1.0 | 45 | $50(Ti_{0.8},Zr_{0.1},Hf_{0.1})N_{0.8}$ 30Al,20WC |
| D | 0.3 | 35 | $65(Ti_{0.5},Cr_{0.2})(C_{0.3},N_{0.7})_{0.85}$ 20Al,15WC |
| E | 0.8 | 50 | $65(Ti_{0.9},Nb_{0.1})(C_{0.1},N_{0.9})_{0.7}$ 30Al,5WC |
| F | 0.8 | 38 | $67(Ti_{0.75},V_{0.25})C_{0.7}$ 25Al,10WC |
| G | 1.0 | 40 | $66Ti(Co_{0.5},N_{0.5})_{0.8}$ 30Al,2WC |
| H | 1.0 | 40 | $55(Ti_{0.77},W_{0.23})(C_{0.5},N_{0.5})_{0.8}$ 20Al,25WC |

* μm
** vol. %

TABLE 1-2

| Sample No. | Atomic Ratio of Ti to Transition Metal Element of the Group IVa, Va, Va excepting Ti |
|---|---|
| A | 87.7:12.3 |
| B | 85.3:14.7 |
| C | 69.2:30.8 |
| D | 74.7:25.3 |
| E | 87.9:12.1 |
| F | 71.9:28.1 |
| G | 98.7:1.3 |
| H | 63.7:36.3 |

TABLE 2

| No. | Result of Cutting, Abrasion Width (mm) |
|---|---|
| A | 0.085 |
| B | 0.091 |
| C | 0.105 |
| D | 0.097 |
| E | 0.125 |
| F | 0.100 |
| G | 0.195 |
| H | broken at 3.1 m |

EXAMPLE 3

Mixed powder materials as listed in Table 3 were prepared to obtain sintered compacts similarly to Example 1. These sintered compacts were applied to manufacture end mills of 16 mm in diameter to cut SKD-11 materials ($H_{RC}$: 60) for 5 m under the following conditions:

Speed of Rotation: 2000 r.p.m.
Axial Depth of Cut: 3 mm
Diametrical Depth of Cut: 0.2 mm
Rate of Feed: 15/100 mm/tooth Table 4 shows the results.

TABLE 3

| No. | cBN Average Particle (μm) | cBN Content (vol. %) | Binder Ti $N_Z$ (wt. %) | Ti $N_Z$ Z value | WC (wt. %) | Al (wt. %) | Atomic Ratio* |
|---|---|---|---|---|---|---|---|
| I | 1 | 30 | 68 | 0.78 | 7 | 25 | 97:3 |
| J | 1 | 35 | 68 | 0.77 | 7 | 25 | 97:3 |
| K | 1 | 45 | 68 | 0.76 | 7 | 25 | 97:3 |
| L | 1 | 55 | 68 | 0.80 | 7 | 25 | 97:3 |
| M | 0.5 | 40 | 68 | 0.79 | 7 | 25 | 97:3 |
| N | 3 | 40 | 65 | 0.75 | 10 | 25 | 95.6:4.4 |
| O | 6 | 40 | 65 | 0.75 | 10 | 25 | 95.6:4.4 |
| P | 1 | 40 | 65 | 0.75 | 10 | 25 | 95.6:4.4 |
| Q | 1 | 40 | 71 | 0.75 | 4 | 25 | 98.3:1.7 |
| R | 1 | 40 | 60 | 0.75 | 15 | 25 | 93.1:6.9 |
| S | 1 | 40 | 57 | 0.80 | 18 | 25 | 91.3:8.7 |
| T | 1 | 40 | 72 | 0.80 | 10 | 18 | 96.0:4.0 |
| U | 1 | 40 | 60 | 0.81 | 10 | 30 | 95.2:4.8 |
| V | 1 | 40 | 55 | 0.82 | 10 | 35 | 94.8:5.2 |
| W | 1 | 40 | 65 | 0.68 | 10 | 25 | 95.7:5.2 |
| X | 1 | 40 | 65 | 0.85 | 10 | 25 | 95.5:4.5 |
| Y | 1 | 40 | 65 | 0.90 | 10 | 25 | 95.5:4.5 |

*Atomic Ratio of Ti to W

TABLE 4

| No. | Result of Cutting in Application to End Mill: Abrasion Width (mm) |
|---|---|
| I | broken at 3.5 m |
| J | 0.060 |
| K | 0.058 |
| L | broken at 4.1 m |
| M | 0.050 |
| N | broken at 4.5 m |
| 0 | broken at 2.1 m |
| P | 0.048 |
| Q | 0.095 |
| R | 0.047 |
| S | 0.073 |
| T | broken at 3.8 m |
| U | 0.052 |
| V | broken at 4.5 m |
| W | broken at 3.2 m |
| X | 0.051 |
| Y | broken at 2.0 m |

EXAMPLE 4

End mills of 6 mm in diameter were manufactured through the samples N and R in Table 1-1, to cut SKD-4 materials ($H_{RC}$: 45) under the following conditions:

Speed of Rotation: 6000 r.p.m.
Axial Depth of Cut: 2 mm
Diametrical Depth of Cut: 6 mm
Feed: 0.2 mm/tooth
Type: Wet For the purpose of comparison, an end mill of cemented carbide of 6 mm in diameter was also applied to cutting at the speed of rotation of 800 r.p.m. under cutting conditions similar to the above.

As the result, the tip of the sample N was broken upon cutting of 7 m, while the abrasion width was 0.13 mm upon cutting of 20 m in the sample R. The end mill of cemented carbide was made incapable of cutting upon cutting of 2 m, with abrasion width of 0.3 mm.

Values of surface roughness of the samples N and R and the end mill of cemented carbide measured upon cutting were 2 μm, 1 μm and 3 μm in $R_{MAX}$.

EXAMPLE 5

$TiN_{0.9}$, $Al_3Ti$ and WC powder were mixed in the weight ratio of 56:34:10. The binder thus obtained contained 21.4 percent by weight of Al while the atomic ratio of Ti to W was 95.9:4.1 and the atomic ratio of Ti to N was 1:0.7. The binder powder was mixed in the volume ratio of 62:38 with cBN powder of 0.7 μm in average particle size, and the mixed powder thus obtained was sintered under superhigh pressure and temperature similarly to Example 1.

Products of the sintered compact thus obtained were examined through X-ray diffraction, so that is was observed that the compact presented a peak of cBN as well as peaks considered as those of (Ti,W)(C,N), $TiB_2$, $AlB_2$, AlN, tungsten boride and alumina. This alumina is believed to be produced by reaction of oxygen adsorbed in the surfaces of the binder and cBN with aluminum.

The sintered compact was worked into an end mill of 12 mm in diameter having effective cutting length of 6 mm to perform a cutting test on an SKH-9 material ($H_{RC}$: 63) under the following conditions:

Speed of Rotation: 2300 r.p.m.
Axial Depth of Cut: 3 mm
Diametrical Depth of Cut: 0.3 mm
Feed: 0.2 mm/tooth For the purpose of comparison, end mills of the same configuration were manufactured through the samples A and H of Example 2 to perform a cutting test under the sane conditions.

Abrasion width of the tool cutting face measured upon cutting of 10 m was 0.058 mm in the end mill of the sintered compact of this Example, while the same was 0.051 mm in the end mill of the sample A of Example 2 and the tip was broken upon cutting of 1.2 m in the end mill employing the sintered compact of the sample H.

EXAMPLE 6

$TiN_{0.7}$, Al and WC powder were mixed in the weight ratio of 68:22:10. The atomic ratio of Ti to W in the binder thus obtained was 95.9:4.1. The binder powders were mixed with cBN powder materials in the ratio as listed in Table 5. The mixed powder materials thus obtained were sintered under a pressure of 45 Kb and a temperature of 1300° C. for 20 minutes to obtain sintered compacts similarly to Example 1.

These respective sintered compacts were worked into tips for cutting works and then cutting tests were performed. Cutting materials were formed on SCM415 and cutting conditions were as follows:

Cutting Speed: 120 m/min
Depth of Cut: 0.2 mm
Feed: 0.1/rev.
Cutting Period: 30 min.

Table 5 also shows the results of the cutting tests.

TABLE 5

| | cBN | | |
|---|---|---|---|
| No. | Average Particle Size (μm) | Content (vol. %) | Result of Cutting Abrasion Width (mm) |
| AA-1 | 3 | 50 | 0.35 |
| AA-2 | 2 | 45 | 0.21 |
| AA-3 | 2 | 40 | 0.16 |
| AA-4 | 1 | 40 | 0.15 |
| AA-5 | 0.5 | 35 | 0.17 |

Although the present invention has been described in detail, it is clearly understood that the same is by way of illustration and example only and is not to be taken by way of limitation, the spirit and scope of the present invention being limited only by the terms of the appended claims.

What is claimed is:

1. A cBN sintered compact for an end mill obtained by sintering mixed powder containing about 35 to 50 percent by volume of cubic boron nitride powder smaller than 2 μm in average particle size and a residue of a binder under cBN-stable conditions, said binder containing about 20 to 30 percent by weight of Al and one or more Ti compounds selected from a group of $TiN_z$, $Ti(C,N)_z$, $TiC_z$, $(Ti,M)C_z$, $(Ti,M)(C,N)_z$ and $(Ti,M)N_z$ (where M indicates a transition metal element of the group IVa, Va or VIa of the periodic table excepting Ti and z is within a range of $0.7 \leqq z \leqq 0.85$), the atomic ratio of the content of Ti in said binder to that of said transition metal element of the group IVa, Va or VIa of the periodic table excepting Ti being about $\frac{2}{3}$ to 97/100 further containing tungsten in the form of at least one of said Ti compound and WC, and the total tungsten concentration in the binder being about 5 to 20 percent by weight.

2. A cBN sintered compact for an end mill in accordance with claim 1, wherein said sintered compact contains, in addition to cBN, one or more selected from a group of TiN, Ti(C,N), TiC, (Ti,M)C, (Ti,M)(C,N) and (Ti,M)N, and one or more selected from a group of titanium boride, aluminum boride, aluminum nitride, a tungsten compound and tungsten.

3. A cBN sintered compact for an end mill in accordance with claim 1, wherein said binder contains about 20 to 30 percent by weight of Al and said Ti compound is $TiN_z$ or $(Ti,W)N_z$ (where about $0.7 \leqq z \leqq$ about 0.85) and said tungsten is contained in said binder by about 5 to 15 percent by weight in the form of tungsten carbide.

4. A cBN sintered compact for an end mill in accordance with claim 1, wherein said Al is mixed in the form of an Al compound.

5. A cBN sintered compact for an end mill in accordance with claim 1, wherein said cBN powder is smaller than about 1 μm in average particle size.

6. A method of manufacturing a cBN sintered compact for an end mill comprising:

a step of mixing about 35 to 50 percent by volume of cubic boron nitride powder smaller than about 2 μm in average particle size with about 50 to 65 percent by voluxe of a binder to obtain mixed powder, said binder containing about 20 to 30 percent by weight of Al and one or more Ti compounds selected from a group of $TiN_zTi(C,N)_z$, $TiC_z$, $(Ti,M)C_z$, $(Ti,M)(C,N)_z$ and $(Ti,M)N_z$ (where M indicates a transition metal element of the group IVa, Va or VIa of the periodic table excepting Ti and z is within a range of about $0.7 \leqq z \leqq$ about 0.85), the atomic ratio of the content of Ti in said binder to that of said transition metal element of the group IVa, Va or VIa excepting Ti being about $\frac{2}{3}$ to 97/100 and total tungsten concentration contained in the form of at least one of said Ti compound and WC in said binder being about 5 to 20 percent by weight; and a step of sintering said mixed powder under cBN-stable superhigh pressure conditions.

7. A method of manufacturing a cBN sintered compact for an end mill in accordance with claim 6, wherein said sintering is performed under a pressure of about over 20 Kb and a temperature of 1000° C. to 1500° C.

8. A method of manufacturing a cBN sintered compact for an end mill in accordance with claim 6, wherein said tunsten is mixed in the form of tunsten carbide.

9. A method of manufacturing a cBN sintered compact for an end mill in accordance with claim 6, wherein said Al is mixed in the form of an Al compound.

* * * * *

UNITED STATES PATENT AND TRADEMARK OFFICE

CERTIFICATE OF CORRECTION

PATENT NO. : 4,693,746

DATED : September 15, 1987

INVENTOR(S) : Tetsuo Nakai, Mitsuhiro Goto

It is certified that error appears in the above-identified patent and that said Letters Patent is hereby corrected as shown below:

In The Abstract: line 15, replace "$\frac{2}{3}$ to $\frac{97}{100}$" by --2 to $\frac{97}{3}$--.

Column 2, line 2, replace "$\frac{2}{3}$ to $\frac{97}{100}$" by --2 to $\frac{97}{3}$--.

Column 2, line 65,

"$\frac{2}{3}$ to $\frac{97}{100}$" by --2 to $\frac{97}{3}$--.

Claim 1, at column 8, line 13, replace "$\frac{2}{3}$ to $\frac{97}{100}$" by --2 to $\frac{97}{3}$--.

Claim 6, at column 8, lines 52 and 53, replace "$\frac{2}{3}$ to $\frac{97}{100}$" by --2 to $\frac{97}{3}$--.

Signed and Sealed this

Thirteenth Day of February, 1990

*Attest:*

JEFFREY M. SAMUELS

*Attesting Officer* *Acting Commissioner of Patents and Trademarks*